US005730627A

United States Patent [19]

Okabe

[11] Patent Number: 5,730,627

[45] Date of Patent: Mar. 24, 1998

[54] TERMINAL RETAINING STRUCTURE FOR A CONNECTOR

[75] Inventor: Toshiaki Okabe, Shizuoka, Japan

[73] Assignee: Yazaki Corporation, Tokyo, Japan

[21] Appl. No.: 667,471

[22] Filed: Jun. 21, 1996

[30] Foreign Application Priority Data

Jun. 23, 1995 [JP] Japan ..... 7-157658

[51] Int. Cl.[6] ..... H01R 13/514

[52] U.S. Cl. ..... 439/752

[58] Field of Search ..... 439/752, 595, 439/596

[56] References Cited

U.S. PATENT DOCUMENTS

| | | | |
|---|---|---|---|
| 5,292,262 | 3/1994 | Endo et al. | 439/752 |
| 5,316,504 | 5/1994 | Jinno | 439/595 |
| 5,378,176 | 1/1995 | Sasai | 439/752 |

FOREIGN PATENT DOCUMENTS

| | | | |
|---|---|---|---|
| 5-226025 | 9/1993 | Japan | H01R 13/42 |
| 6-151002 | 5/1994 | Japan | H01R 13/42 |

*Primary Examiner*—Neil Abrams
*Assistant Examiner*—T. C. Patel
*Attorney, Agent, or Firm*—Sughrue, Mion, Zinn, Macpeak & Seas

[57] ABSTRACT

A terminal retaining structure for a connector in which a terminal retaining member (2) is allowed to enter into a connector housing (3) from an opening (6) facing a terminal accommodating chamber of the connector housing. The terminal retaining member has a terminal retaining projection (13) in the front thereof and a notched stepped portion (14) in the rear thereof. In such terminal retaining structure, a primary temporary retaining projection (15) and a secondary temporary retaining projection (16) are arranged on an overhang wall portion (12) so as to be staggered in a terminal retaining member insertion direction. The overhang wall portion has the terminal retaining projection (13) of the terminal retaining member (2) projected therefrom. The primary temporary retaining projection (15) and the secondary temporary retaining projection (16) are engageable with the side end edges of the opening sequentially. The notched stepped portion (14) is brought into contact with and supported on an outer housing wall (9) after the secondary temporary retaining projection (16) has passed by the corresponding side end edge of the opening (6). As a result, the terminal retaining projection (13) is allowed to enter obliquely into the opening to come in contact with the inner housing wall.

13 Claims, 4 Drawing Sheets

TERMINAL RETAINING STRUCTURE FOR A CONNECTOR

BACKGROUND OF THE INVENTION

1. Field of the Invention

The invention relates to a terminal retaining structure for a connector that can guide a rear holder for retaining terminals reliably in a terminal retaining direction by regulating the entering path of the rear holder.

2. Related Art

FIG. 7 shows a conventional terminal retaining structure for a connector disclosed in Unexamined Japanese Patent Publication No. Hei. 6-151002.

As can be seen, notched grooves 26 are formed in both side portions of a connector housing 25 and a plurality of guide projections 27 extend outwardly from the notched grooves 26. These projections function to movably secure a terminal retaining member 30 to the connector housing 25. The guide projections 27 extend along an arc. The terminal retaining member 30 has opposing side walls 28 that are respectively received in the notched grooves 26, and arc-shaped grooves are formed in the side walls 28. The projections are received in the grooves so as to smoothly guide the terminal retaining member.

Retaining wall portions 32 that face terminal accommodating chambers 31 of the connector housing 25 are formed in the front end of the terminal retaining member 30. As shown in FIG. 8, a terminal 33 is insertable into a terminal receiving chamber in the connector housing while the terminal retaining member 30 is located in a temporary position with respect to the connector housing 25. After the connector has been completely inserted, the terminal retaining member 30 can be pushed forward so that the retaining wall portion 32 in the front end thereof contacts a rear end portion 33*a* of the terminal 33. Under this condition the terminal retaining member 30 is completely retained. During the operation of pushing the terminal retaining member 30, the arc-shaped holes 29 slide along the respective guide projections 27, which in turn allows the guide projections 27 to guide the terminal retaining member 30.

However, the thus constructed conventional terminal retaining mechanism has experienced the following problem. Since the guide projections 27 for guiding the terminal retaining member 30 are arranged on both sides of the connector housing 25, the width of the connector housing 25 is increased, which in turn results in a connector 34 (the connector housing 25 with a terminal inserted thereinto) which is too large.

The invention has been made in view of the aforementioned problem. The object of the invention is therefore to provide a terminal retaining structure for a connector that can guide the terminal retaining member reliably without increasing the size of the connector.

SUMMARY OF THE INVENTION

A terminal retaining structure for a connector in which a terminal retaining member is allowed to enter into a connector housing from an opening that communicates with a terminal accommodating chamber of the connector housing. The terminal retaining member has a terminal retaining projection in the front thereof and a notched stepped portion in the rear thereof. With such a terminal retaining structure, a primary temporary retaining projection and a secondary temporary retaining projection are arranged on an overhang wall portion so as to be staggered in a terminal retaining member insertion direction. The overhang wall portion has the terminal retaining projection of the terminal retaining member projected therefrom. The primary temporary retaining projection and the secondary temporary retaining projection are engageable with side end edges of the opening sequentially. The notched stepped portion is brought into contact with and supported by an outer housing wall with the secondary temporary retaining projection having passed over the side end edge of the opening, which in turn allows the terminal retaining projection to enter obliquely into the opening and be positioned therein so as to be in contact with an inner housing wall.

The side end edges of an opening of the connector housing are interposed between the primary temporary retaining projection and the secondary temporary retaining projection of the terminal retaining member with the primary temporary retaining projection having passed over the corresponding side end edge of the opening of the connector housing. A terminal is accommodated in the connector housing under this condition of primary temporary retainment. By pushing the terminal retaining member in the terminal retaining direction, the secondary temporary retaining projection passes over the corresponding side end edge of the opening. Since the notched stepped portion in the rear of the terminal retaining member is supported on the outer housing wall, the terminal retaining projection is allowed to enter obliquely into the opening and comes in contact with the inner housing wall, which in turn blocks provide guidance for the terminal retaining projection. Hence, the terminal retaining member is guidably supported in the terminal retaining direction.

DETAILED DESCRIPTION OF THE INVENTION

Figure 1:
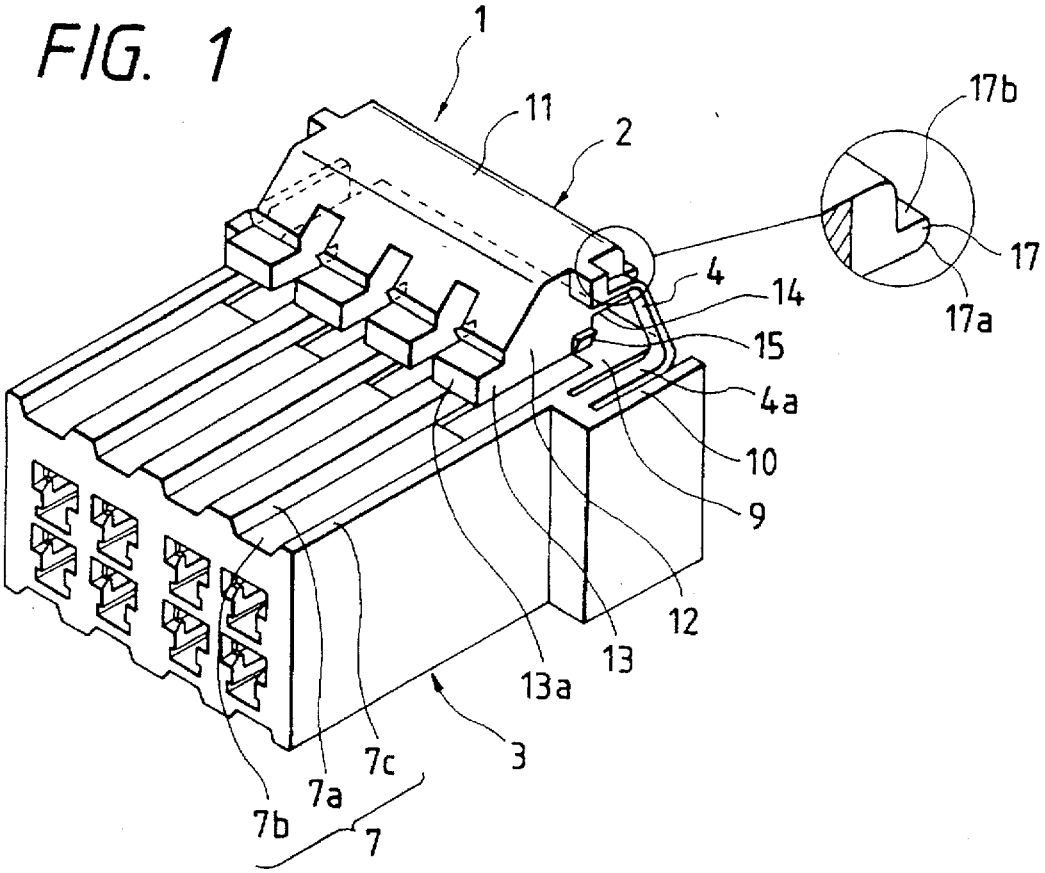
FIG. 1 is a perspective view showing a dual retained connector having a terminal retaining structure for a connector, which is an embodiment of the invention.
Figure 2:
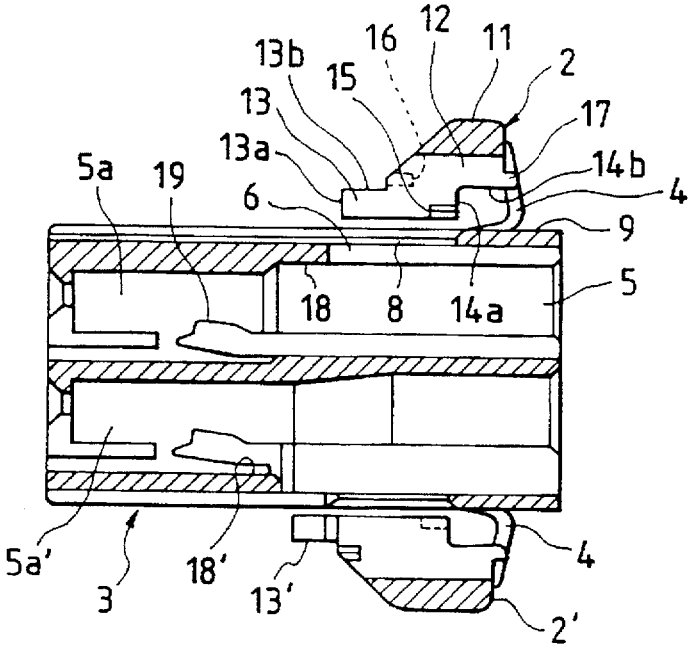
FIG. 2 is a sectional view of the dual retained connector shown in FIG. 1.

FIGS. 1 and 2 show a terminal retaining structure for a connector, which is an embodiment of the invention.

This structure relates to a mechanism which includes temporary retaining rear holders (terminal retaining members) 2, 2' in a connector 1 so that the terminals received in the connector are retained in a dual manner. In this embodiment, a pair of rear holders (terminal retaining members) 2, 2' are integrally secured to upper and lower portions of the connector housing 3 by means of hinge bands 4. The connector housing is made of a synthetic resin.

The upper rear holder (terminal retaining member) 2 will hereunder be described, with the understanding that the lower rear holder 2' has a similar configuration.

Figure 3:
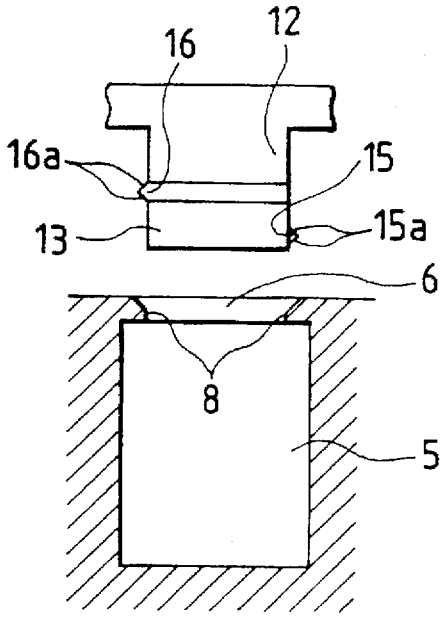
FIG. 3 is a sectional view of an opening edge of a connector housing for a temporary retaining projection of a rear holder.

A plurality of openings 6 are juxtaposed at the upper rear portion of the connector housing 3. The openings 6 are continuous to terminal accommodating chambers 5 that are arranged in two, upper and lower, levels. Each opening 6 is interposed between tapered guide wall portions 7*a*. The tapered guide wall portions 7*a* are part of a recessed portion 7 formed in the upper wall of the housing. The tapered guide wall portions 7*a* of each opening 6 depict an inverted trapezoid. As shown in FIG. 3, projecting walls 8 are formed on both side edges of each opening 6. The projecting walls 8 are substantially coplanar with the bottom portion 7*b* of the recessed wall 7.

A flat upper housing wall surface 9 continues from the rear end of the projected walls 8. The upper housing wall surface 9 is above the projecting walls 8 so as to be substantially coplanar with the top portion 7*c* of the recessed wall 7.

The rear portion of the housing includes a projecting portion which projects outwardly from both sides of the connector and which includes an upper wall 10 which is continuous with outer wall 9. Extending from the upper walls 10 are hinge bands 4, including a base portion 4*a*, which function to interconnect the rear holder 2 to the upper housing wall 9. Each hinge band 4 is located on the side of the connector housing 3. The front end of the hinge band 4 is fastened to the side portion of the rear holder 2. The hinge band 4 may, of course, be arranged on the rear of the rear holder 2, instead of the side.

The rear holder 2 includes a top plate portion (main plate portion) 11 from which a plurality of overhang wall portions 12 projection in a comb-like manner so as to correspond to the openings 6 of the connector housing 3, respectively. The top plate portion 11 serves as an operating portion. A terminal retaining projection 13 projects frontward from each corresponding overhang wall portion 12 at the lower end of such overhang wall portion 12 so as to extend horizontally in a terminal inserting direction. The bottom rear portion of overhang wall portion 12 of the rear holder 2 is notched so as to form a notched stepped portion 14. The depth of the notched portion corresponds to the vertical thickness of the terminal retaining projection 13.

The forwardmost end of the terminal retaining projection is defined by a vertical contact surface 13*a* which is designed to abut against a rear stepped portion 20*a* of a terminal 20 when the rear holder is in the completely engaged position. The distance between the contact surface 13*a* and an end surface 14*a* of the notched stepped portion 14 is set to a value slightly shorter than the length of the opening 6 extending in the longitudinal direction of the connector. The notched stepped portion 14 has a flat, horizontally extending contact surface 14*b* that confronts the upper wall surface 9 in the rear of the connector housing 3. The contact surface 14*b* is continuous to the end surface 14*a* and these surfaces form a right angle.

A primary temporary retaining projection 15 is arranged on one side surface of the overhang wall portion 13 in the front of the notched stepped portion 14 and a secondary temporary retaining projection 16 is arranged on the other side surface of the overhang wall portion 12. The secondary temporary retaining projection 16 is located higher than the primary temporary retaining projection 15. The primary temporary retaining projection 15 is arranged close to the notched stepped portion 14 in the rear, whereas the secondary temporary retaining projection 16 is arranged close to the base of the terminal retaining projection 13 in the front.

The distance in the vertical direction between temporary retaining projections 15, 16 is substantially equal to or slightly larger than the thickness of the projected wall 8 on the opening edge of the connector housing 3. Both temporary retaining projections 15, 16 are formed to have a triangular cross section and have upper and lower sliding and retaining tapered surfaces 15*a*, 16*a*, as shown in FIG. 3. The respective temporary retaining projections 15, 16 may be arranged on each overhang wall portion 12, or only on the outermost overhang wall portions 12.

A regular retaining projection 17 projects rearward from the rearmost end of the overhang portion 12 at the upper end of the notched stepped portion 14. The regular retaining projection 17 has a downwardly facing guide slope 17*a* and an upwardly facing horizontal retaining surface 17*b*, as shown in FIG. 1.

The connector housing 3 includes an inner housing wall 18 (FIG. 2) located at an upper portion of the terminal accommodating chamber 5 and at the front of the opening 6 of the connector housing 3. The inner housing wall 18 is located one step higher than a contact portion accommodating chamber 5*a* that is in the first half of the terminal accommodating chamber 5. The inner housing wall 18 is contacted by an upper surface 13*b* of the terminal retaining projection 13. A flexible terminal retaining lance is arranged on the bottom of the contact portion accommodating chamber 5*a*. Further, a contact wall 18' for receiving a terminal retaining projection 13' of the lower rear holder 2' is formed at the same height on the bottom wall of a lower contact portion accommodating chamber 5*a'* out of the upper and lower contact portion accommodating chambers. The lower rear holder 2' is formed so as to be a size larger than the upper rear holder 2. The terminal retaining projection 13' is also located slightly frontward with respect to the upper terminal retaining projection 13.

Figure 4:
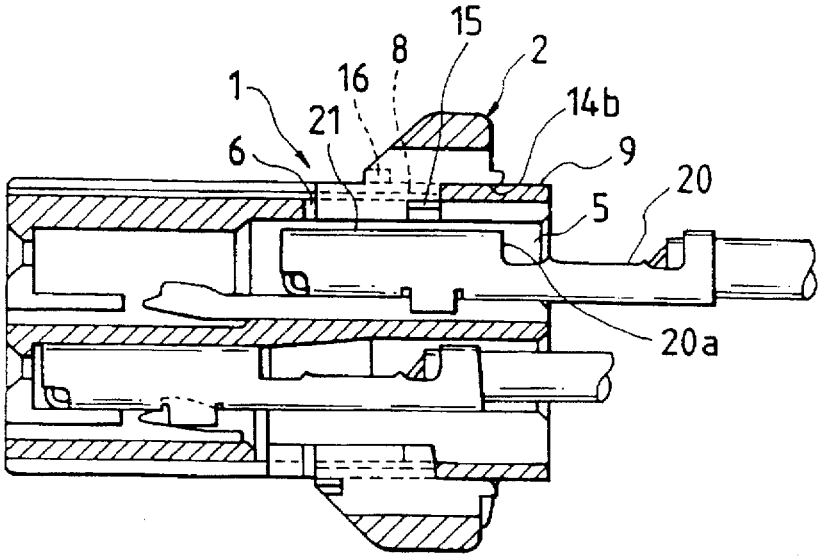
FIG. 4 is a sectional view of the dual retained connector with the rear holder subjected to primary temporary retainment.
Figure 5:
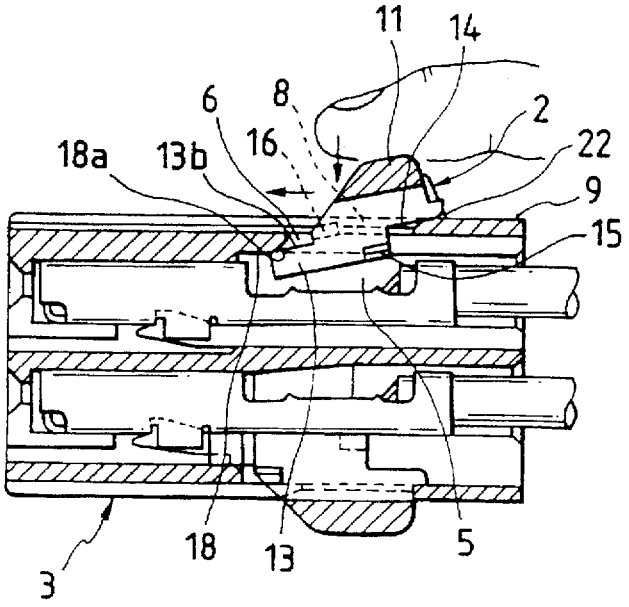
FIG. 5 is a sectional view of the dual retained connector with the rear holder subjected to secondary temporary retainment as it moves to the completely retained position.
Figure 6:
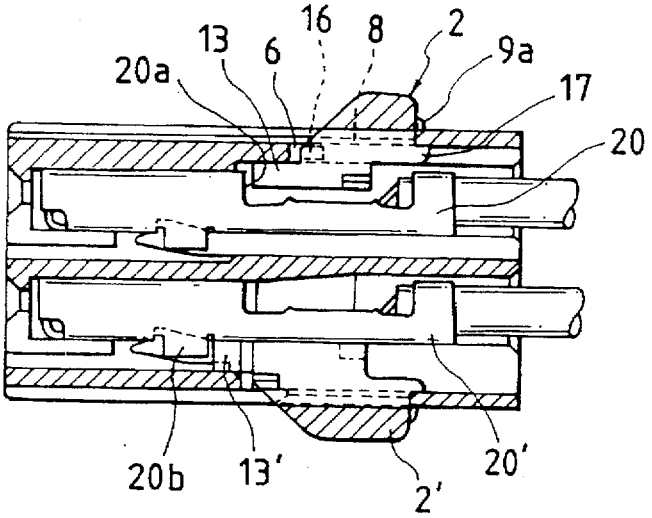
FIG. 6 is a sectional view of the dual retained connector with the rear holder regularly retained.
Figure 7:
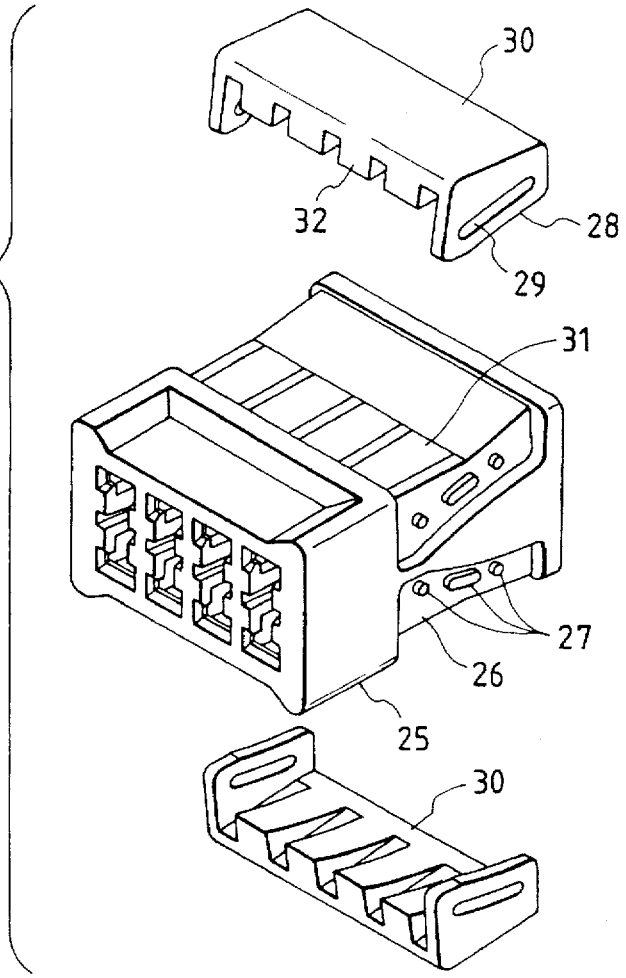
FIG. 7 PRIOR ART
FIG. 7 is an exploded perspective view of a conventional example.
Figure 8:
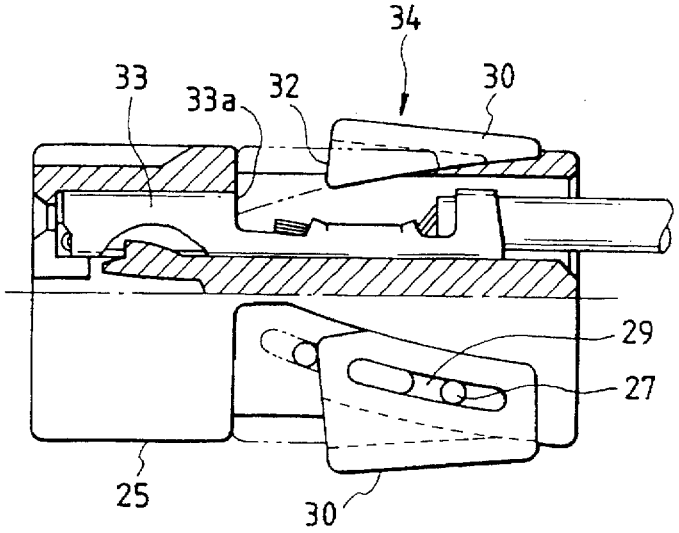
FIG. 8 PRIOR ART
FIG. 8 is a sectional view of the conventional example.

FIGS. 4 to 6 show an operation of the doubly retained connector 1.

FIG. 4 shows the upper rear holder 2 subjected to primary temporary retainment. In the temporarily retained position, the primary temporary retaining projection 15 and the secondary temporary retaining projection 16 are located on opposite sides of the edges defining the opening of the connector housing 3. In other words, the projected walls 8 are disposed between the primary and temporary retaining projections 15 and 16. In this position, the contact surface 14*b* of the notched stepped portion 14 in the rear of the rear holder contacts the upper housing wall surface 9, so that the rear holder 2 is located horizontal. The primary temporary retaining projection 15 that is on the lower side is located inside the opening 6. The temporary retaining projections 15, 16 can pass through the opening 6' smoothly along the tapered guide wall portions 7*a* (FIG. 3). The terminal 20 is inserted into the accommodating chamber 5 with the rear holder 2 being under the condition of primary temporary retainment.

FIG. 5 shows a condition in which the terminal retaining projection 13 is urged into the terminal accommodating chamber 5 obliquely after the primary temporary retainment of the rear holder 2 has been released by pushing the top plate portion 11 downward as indicated by the vertical arrow. During this process, the rear holder 2 is turned obliquely downward so as to pivot about a contact point 22 between the notched stepped portion 14 and the upper housing wall 9. As a result, the primary temporary retaining projection 15 moves away from the projected wall 8 of the opening 6, which in turn causes the secondary temporary retaining projection 16 to slide by the corresponding projected wall 8 to engage with the lower side of the projected wall 8. As a result, the upper surface 13*b* of the terminal retaining projection 13 contacts a lower end edge 18*a* that is in the front of the opening 6, i.e., the front end portion of the inner housing wall 18, so that the rear holder 2 is subjected to secondary temporary retainment.

In this position, the rear holder 2 is supported obliquely with respect to the connector housing 3 at two points, i.e., the notched stepped portion 14 and the terminal retaining projection 13. Accordingly, the terminal retaining projection 13 is properly located and the insertion path of the rear holder 2 established. As a result, the terminal retaining projection 13 of the rear holder 2 can be guided and positioned at the rear stepped portion 20*a* of the terminal 20 reliably without providing the conventional guide mechanism.

FIG. 6 shows a condition in which the terminal retaining projection 13 is brought into contact with the rear stepped portion 20*a* of the terminal 20 after the rear holder 2 is pushed frontward from the condition shown in FIG. 5. The secondary temporary retaining projection 16 passes by the projecting wall 8 of the opening 6 and the regular retaining projection 17 on the rear end of the rear holder engages the rear end edge 9*a* of the opening 6. As a result, the rear holder 2 is retained.

It may be noted that the lower rear holder 2' causes a terminal retaining projection 13' to come in contact with a lower rear end portion 20*b* of a terminal 20', i.e., a stabilizer. The construction and operation of the lower rear holder 2' are similar to those of the upper rear holder 2.

As described in the foregoing, the invention is characterized as causing the secondary temporary retaining projection of the terminal retaining member to pass by the corresponding end edge of the opening of the connector housing with the notched stepped portion on the rear side of the terminal retaining member supported on the outer housing wall. As a result the terminal retaining projection is allowed to enter obliquely into the opening so to as to come in contact with the inner housing wall thereby preventing the floating of the terminal retaining projection. As a result of this construction, the terminal retaining member is guidably supported in the terminal retaining direction. Hence, it is no longer necessary to include a terminal retaining member guide mechanism which projects outward from the connector housing as in the conventional example, which in turn contributes to downsizing the connector. Further, since the floating of the terminal retaining projection can be prevented, reliable terminal retaining operation can be performed.

I claim:

1. A connector comprising:

a connector housing a terminal receiving chamber, an external wall of said including an opening therein which communicates with said terminal receiving chamber, said opening being at least partially defined by a projecting wall; and a rear holder secured to said connector housing and being moveable from a temporarily retained position, at which a terminal is insertable into said receiving chamber, to a completely retained position, at which said terminal is retained in said housing by said rear holder, said rear holder including a terminal retaining projection extend in a forward direction which abuts against said terminal when said rear holder is in said completely retained position, and first and second retaining projections provided on said terminal retaining projection for retaining said rear holder in said temporarily retained position, said first and second retaining projections being vertically offset from each other such that when said holder is in said temporarily retained position, said first retaining projection is on an outside of said opening abutting against an outside surface of said projecting wall and said second retaining projection is on an inside of said opening abutting against an inside surface of said projecting wall.

2. The connector of claim 1, wherein said first and second retaining projections have triangular cross-section.

3. The connector of claim 1, wherein said rear holder is moved from said temporarily retained position to said completely retained by obliquely orienting said rear holder with respect to said connector housing.

4. The connector of claim 1, wherein when said rear holder is in said completely retained position said terminal retaining projection contacts an inner surface of said connector housing.

5. The connector of claim 1, wherein said connector housing has a plurality of said terminal accommodating chambers and said rear holder includes a corresponding number of terminal retaining projections.

6. The connector of claim 1, where the vertical distance between said first and second retaining projections is at least as large as the thickness of said projecting wall.

7. A connector, comprising:

a connector housing having a terminal receiving chamber, an external wall of said housing including an opening therein which communicates with said terminal receiving chamber, said opening being at least partially defined by a projecting wall; and a rear holder secured said connector housing and being moveable from a temporarily retained position, at which a terminal is insertable into said terminal receiving chamber, to a completely retained position, at which said terminal is retained in said housing by said rear holder, said rear holder including a terminal retaining projection extending in a forward direction which abuts against said terminal when said rear holder is in said completely retained position, and first and second retaining projections for retaining said rear holder in said temporarily retained position, said first and second retaining projections being vertically offset from each other such that when said rear holder is in said temporarily retained position, said first retaining projection is on an outside of said opening abutting against an outside surface of said projecting wall and said second retaining projection is on an inside of said opening abutting against an inside surface of said projecting wall, wherein said first and second retaining projections are offset in an insertion direction of said terminal.

8. The connector of claim 1, wherein said rear holder further includes a final retaining projection which abuts against an inside surface of said connector housing when said terminal is in said completely retained position.

9. The connector of claim 8, wherein said final retaining projection includes an inside surface to allow said final retaining projection to pass by said projecting wall.

10. The connector of claim 9, wherein said first and second retaining projections are respectively on opposite sides of said retaining projection.

11. The connector of claim 10, wherein said final retaining projection extends from a rear side of said rear holder.

12. The connector of claim 7, wherein said rear holder includes a notched portion at a rear end thereof which defines a contact surface which contacts an exterior surface of said connector housing when said holder is in said temporarily retained position.

13. The connector of claim 12, wherein the vertical dimension of said notched portion is substantially the same as the vertical dimension of said terminal retaining projection.

* * * * *